United States Patent [19]

Schoepe et al.

[11] 3,988,785

[45] Nov. 2, 1976

[54] VALVE SEAT AND CLOSURE MEMBER ASSEMBLY OF FLUSH VALVES FOR FLUSH TANKS AND THE LIKE

[76] Inventors: Adolf Schoepe, 1620 N. Raymond Ave., Fullerton, Calif. 92631; Fredric E. Schmuck, 535 Century Drive, Anaheim, Calif. 92805

[22] Filed: Aug. 15, 1974

[21] Appl. No.: 497,524

[52] U.S. Cl. ..... 4/57 P; 4/57 R; 4/55; 4/52

[51] Int. Cl.[2] ..... E03D 1/34

[58] Field of Search ..... 4/52, 57 P, 57 R, 55

[56] References Cited

UNITED STATES PATENTS

| | | | |
|---|---|---|---|
| 2,557,743 | 6/1951 | Howe | 4/56 |
| 2,801,021 | 7/1957 | Wood | 4/295 X |
| 2,908,018 | 10/1959 | Petrie | 4/57 P X |
| 3,369,259 | 2/1968 | Harold | 4/57 R |
| 3,587,117 | 6/1971 | Ward | 4/55 |

*Primary Examiner*—Richard E. Aegerter
*Assistant Examiner*—Larry Jones
*Attorney, Agent, or Firm*—Mahoney, Schick & Cislo

[57] ABSTRACT

A valve seat of an integrated valve seat and closure member assembly is secured by waterproof sealant over the upper end of a flush valve seat portion in a flush tank, the waterproof sealant preferably constituting the sole support for the integrated assembly in the flush tank. The closure member is hingedly connected to the valve seat through a rigid frame which is partially removably telescoped by a resilient material closure portion thereby mounting the closure portion of the closure member hingedly movable downwardly toward and upwardly away from a sealing position with the valve seat. An outwardly depending C-shaped leg on the closure portion of the closure member which inwardly telescopes the closure member frame provides a lower, relatively flat, sealing surface for sealing downwardly against the valve seat in the closure member sealing position. The valve seat preferably has two, upwardly projecting, convex, concentric rings against which the closure member flat resilient sealing surface seals in the closure member sealing position, one of said valve seat convex rings providing initial sealing until the closure member is permanently compressed and then both rings providing the sealing thereafter.

14 Claims, 5 Drawing Figures

VALVE SEAT AND CLOSURE MEMBER ASSEMBLY OF FLUSH VALVES FOR FLUSH TANKS AND THE LIKE

BACKGROUND OF THE INVENTION

This invention relates to a valve seat and closure member assembly of flush valves for flush tanks and the like, and more particularly, to such an assembly which may include a unique and separately usable closure member structure, a unique and separately usable valve seat structure, and a unique valve seat and closure member integrated assembly. The valve seat may comprise two, concentric, sealing ring portions, one of which seals with a closure member during initial use and the other of which joins in such sealing during later use providing an overall improved sealing function. The closure member may be comprised of a rigid frame which is removably telescoped in an improved secure manner by a resilient material closure portion and a sealing surface on the closure portion is retained securely against the valve seat by the rigid frame in the closure member sealing position, thereby again providing improved sealing characteristics. In the integrated assembly, the valve seat and closure member are preferably hingedly connected providing continual guided alignment for the closure member in its repeated opening and closing movements relative to the valve seat, and such integrated assembly in the preferred form may be installed in a flush tank solely supported and attached by the assembly valve seat either as a flush tank original assembly or as a replacement assembly.

Generally, the water storage in and the water flow into and from usual flush tanks such as the flush tanks of toilets in households, is controlled by a ball cock assembly and a flush valve assembly, the ball cock assembly controlling the water flow into and the maintainment of a water level within the flush tank, and the flush valve assembly basically controlling the flow of water from the flush tank in a flushing operation of a connected toilet bowl. The ball cock assembly is comprised primarily of a float controlled inlet water valve connected in communication with an inlet water line, the ball cock being opened by downward movement of the float upon the exit of the water from the flush tank by actuation of the flush valve assembly and being closed by the float when the flush tank is refilled and the float reaches a predetermined maximum upward position as determined by the flush tank water level. The flush valve assembly is primarily comprised of a selectively operable exit water valve located at the lower extremity of the flush tank and in closed position, working in conjunction with the ball cock assembly to maintain the desired water level within the flush tank, but in open position, permitting the flow of water from the flush tank downwardly through the toilet bowl for the flushing operation.

Specifically, the usual flush valve assembly may include an overflow tube portion and a valving portion which are interconnected by a flush valve seat portion. The flush valve seat portion usually consists of a tubular part opening downwardly through the bottom wall of the flush tank in communication into the toilet bowl to be flushed, the tubular part having an upper open end spaced slightly upwardly within the flush tank with such upper end serving as or directly underlying a valve seat. The flush valve seat portion may be formed integral with the flush tank itself or may be formed by a separately secured and sealed tubular part.

The overflow tube portion of the flush valve assembly is usually formed by an upright metal tube having an upper open end spaced above the normal flush tank water level. The overflow tube lower end is usually secured to the flush valve seat portion for rigid mounting of the overflow tube within the flush tank and this lower end is connected in closed flow communication with the flush valve seat portion below the valve seat forming upper end of the flush valve seat portion. Thus, the overflow tube communicates in closed flow communication at all times from its open upper end spaced above the flush tank normal water level downwardly through the overflow tube into the flush valve seat portion below the valve seat forming part thereof and downwardly through the flush valve seat portion freely into the connected toilet bowl and the water flow therethrough is not controlled by the valving portion of the overall flush valve assembly.

This means that regardless of open or closed positioning of the valving portion of the flush valve assembly, if the water level in the flush tank should rise above its normally intended maximum water level, for instance, as a result of malfunction of the ball cock, such flush tank water level can never rise above the upper open end of the overflow tube since the water will flow freely downwardly through the overflow tube and from the flush tank into the connected toilet bowl. This overflow tube thereby regulates and positively determines the maximum water level that can be attained within the flush tank regardless of ball cock failure and continued inlet water flow preventing water overflow of the flush tank proper. The overflow tube is additionally used to receive a predetermined quantity of water from the ball cock to refill the toilet bowl to a predetermined level during normal operation of the valving portion of the flush valve assembly in the normal manner.

The valving portion of the flush valve assembly and with which the principles of the present invention are involved includes the previously described valve seat formed by or formed sealed on the upper open end of the flush valve seat portion, and a closure portion mounted movable toward and away from the valve seat. In all prior flush valve assemblies, to our knowledge, the closure portion of this valving portion has always been mounted movably guided by the rigid overflow tube, such overflow tube being mounted adjacent the flush valve seat portion extending upwardly adjacent the valve seat so as to be convenient for such purpose. The prior closure portions have either been mounted directly vertically movable through guides projecting out from the overflow tube or hingedly movable by hinged connection thereof directly to the overflow tube, in either case, movable toward and away from the underlying valve seat at the upper end of the flush valve seat portion to open and close the valving portion of the flush valve assembly.

In general operation of the valving portion of the flush valve assembly, with the flush tank filled with water to its normal water level and the closure member moved downwardly sealing against the valve seat on the flush valve seat portion, manipulation of the usual flush actuating lever of the flush tank through a chain connection raises or moves the closure member upwardly away from the valve seat permitting the flush tank water to flow downwardly through the now open flush valve seat portion and through the toilet bowl. Upon the raising of the closure member upwardly away from the valve seat, flotation means provided in the closure member retains the same upwardly until the flush tank water level approaches the level of the valve seat, at which time, the closure member through its flotation means follows the water level down to the valve seat gradually closing the closure member onto the valve seat. At the same time, as the valving portion of the flush valve assembly is approaching and carrying out its closing operation, the lowering of the water level within the flush tank has caused the previously-discussed ball cock float to move downwardly sufficiently for actuating and opening the ball cock admitting water into the flush tank for refilling the same to its predetermined and ball cock controlled water level once the valving portion has closed.

One of the major difficulties with the prior valving portions of the flush valve assemblies has been the problem of establishing and maintaining proper sealing of the closure portion with the valve seat. As pointed out, in the prior assemblies, the valve seat is permanently established and maintained at the upper end of the rigid flush valve seat portion and the closure member necessarily co-operable therewith to establish the proper valving action is guided on the upright overflow tube, there being no direct connection between the valve seat and the closure member other than the mounting connection between the flush valve seat portion and the overflow tube. In the installation of the closure members of the prior flush valve assemblies, therefore, it has been somewhat difficult to establish and maintain the exact proper alignment of the closure members with the overflow tube in order to establish and maintain the necessary proper alignment during closure member movement toward and away from the valve seat.

If the closure member of the flush valve assembly does not close and seal watertight against the valve seat after every flushing action, water leakage through the valving portion will occur between such flushing actions. This not only creates a waste of water, which can be considerable over a period of time, but also creates a noise problem which can become quite irritating. With a constant water loss from the flush tank through the valving portion of the flush valve assembly, the water level in the flush tank gradually decreases and ultimately the controlling float of the previously-described ball cock drops to a level sufficient to actuate the ball cock and admit a sufficient amount of water into the flush tank to refill the same to its predetermined intended water level. The inflowing water into the flush tank creates noise and if repeated frequently, it becomes an irritating noise.

Even after proper alignment has been accomplished between the valve seat and closure member in the flush valve assembly, after repeated use over a period of time, the closure member can become worn and distorted so that improper leakage begins to occur. This requires replacement of the closure member in order to re-establish the proper valving function. Thus, with the prior flush valve assemblies, the alignment problems are again encountered and similar difficulties presented.

Still further, in view of the fact that these flush valve assemblies are constantly immersed in water, the well-known consequences of water-corrosive action and sediment buildup occur to the surfaces of the valve seat and closure portion of the flush valve assembly. If these corrosion and sediment buildup actions ultimately require replacement of the closure member, the above-discussed replacement and re-alignment difficulties are presented, but these same corrosion and sediment buildup actions can take place on the valve seat surfaces and although they will ultimately cause similar unwanted leakage problems, the solving of such problems involves different difficulties. If valve seat replacement is required and the valve seat has originally been formed as an integral part of the upper end of the flush valve seat portion, replacement can only be accomplished by replacing the entire flush valve seat portion or by installing a replacement valve seat overlying and sealed to the original flush valve seat portion, either of which again presents the alignment problems. Similar replacement and alignment problems are also presented if the original valve seat is a separate valve seat ring sealed on the upper end of the flush valve seat portion.

OBJECTS AND SUMMARY OF THE INVENTION

It is, therefore, an object of this invention to provide a valve seat and closure member assembly of flush valves for flush tanks and the like wherein the valve seat and closure member assembly is preferably formed as an integrated assembly in which the closure member is mounted directly guided by the valve seat in the closure member movement between its open and closed positions and, at least from the closure member guiding standpoint, the integrated assembly is completely independent of any other flush valve assembly or flush tank components. With such integrated assembly, mere mounting of the valve seat on the upper end of the flush valve seat portion and the proper sealing therebetween automatically establishes the proper alignment between the valve seat and closure member for perfect valving action since such proper alignment has originally been properly established in the original assembly of the valve seat and closure member. Thus, the discussed troublesome alignment problems are completely eliminated and periodic replacements can be made with the same alignment problem avoidance.

It is a further object of this invention to provide a valve seat and closure member assembly of flush valves for flush tanks and the like wherein, in the optimum problem avoidance form, the valve seat and closure member assembly may not only be formed as an integrated assembly, but a completely independent integrated assembly having its sole connection to the flush tank through the upper end of the flush valve seat portion. In this optimum form, the closure member is preferably hingedly connected directly to the valve seat for maximum rigidity and guiding therebetween during closure member movement relative to the valve seat for positive maintainment of proper alignment. Furthermore, the valve seat is mounted sealed downwardly to the upper end of the flush valve seat portion which preferably constitutes the sole support of the integrated valve seat and closure member assembly. Thus, the optimum form of the valve seat and closure member integrated assembly of the present invention eliminates any dependence on other flush valve assembly or flush tank components and is conveniently usable with virtually any flush tank installation while still providing maximum performance qualities.

It is still a further object of this invention to provide a valve seat and closure member assembly of flush valves for flush tanks and the like wherein, in the preferred valve seat and closure member integrated assembly form, the valve seat is solely supported on and secured to the flush valve seat portion of the flush tank preferably by a waterproof sealant and without any additional sealing or fastening means. In this preferred form, the valve seat includes a valve seat ring having the closure member including its closure portion movably mounted and guided thereon and cooperating to provide the valving function. The valve seat ring of the integrated assembly is positioned overlying the upper end of the flush valve seat portion and is secured to this upper end by the waterproof sealant. In installation of the valve seat and closure member integrated assembly in a flush tank, therefore, whether this integrated assembly is an original assembly or a replacement assembly, it is merely a matter of adhering the integrated assembly to the upper end of the particular flush valve seat portion with the waterproof sealant, thereby providing a completely new and independent valving portion serving the valving function which is self-aligning without dependence on any other flush tank components.

It is an additional object of this invention to provide a valve seat and closure member assembly of flush valves for flush tanks and the like wherein the closure member, whether used in the integrated assembly or used separate therefrom with other valve seat installations, provides unique and improved sealing functions and has positive sealing characteristics. The closure member of the present invention preferably includes a rigid frame selectively removably mounting a closure portion, the closure portion in preferred form being comprised totally of resilient material and particularly an annular sealing surface thereof predicated to seal with a valve seat during the valving function. The closure portion is removably mounted on the rigid frame with an annular surface of the rigid frame backing the closure portion sealing surface so that the rigid frame always perfectly locates the closure portion sealing surface and assures sealing contact thereof with the valve seat.

It is still another object of this invention to provide a valve seat and closure member assembly of flush valves for flush tanks and the like wherein the valve seat, whether used in the integrated assembly or independent thereof, preferably includes a unique sealing surface which assures proper watertight sealing with a closure member over a long period of valving function use. The valve seat includes a valve seat ring having an upper sealing surface formed with preferably two, upwardly projecting sealing ring portions, the first ring portion projecting upwardly a greater amount and the second ring portion projecting upwardly a lesser amount. Thus, in use of the valve seat ring with a resilient material or similar sealing surface of a closure member in the valving function, during initial use, the closure member seals with the greater projecting sealing ring portion until such greater projecting sealing ring portion has permanently impressed the closure member sealing surface, after which, both sealing ring portions function in the sealing operation providing maximum sealing perfection over a long period of useful life.

Other objects and advantages of the invention will be apparent from the following specification and the accompanying drawings which are for the purpose of illustration only.

DESCRIPTION OF THE BEST EMBODIMENT CONTEMPLATED

Figure 1:
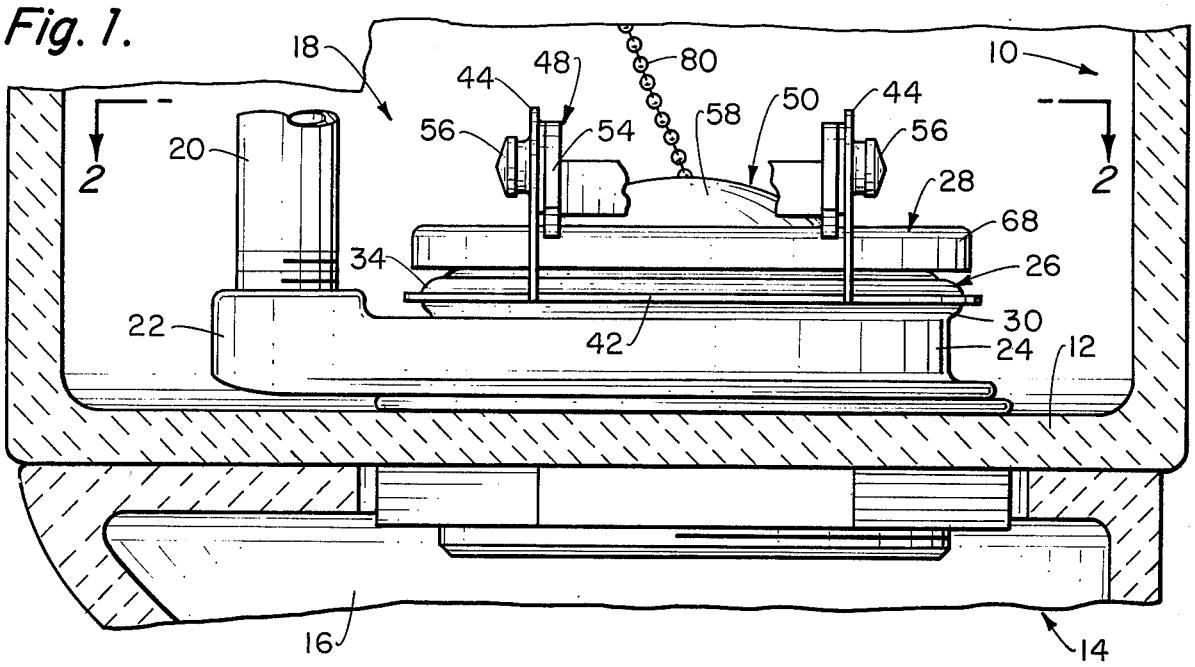
FIG. 1 is a fragmentary, vertical sectional view of a typical flush tank installation having a flush valve installed therein, shown in end elevational view, and incorporating a preferred embodiment of the valve seat and closure member assembly of the present invention, the valve seat and closure member assembly being shown in closed sealing position.

Referring generally to the drawings, the unique valve seat and closure member assembly with its individually unique valve seat and closure member components is illustrated herein in conjunction with an overall flush valve assembly installed in a flush tank of a usual toilet. Such showing of the principles of the present invention is not, however, intended to limit to the particular use illustrated, but rather, the broader principles of the valve seat and closure member inventions disclosed and claimed herein are applicable to various similar uses and accordingly should be so construed. Furthermore, all of the environmental components, as well as the specific components of the valve seat and closure member assembly inventions, may be formed by usual manufacturing methods and procedures, and of usual materials, except as otherwise herein specifically pointed out.

As shown, a usual water flush tank generally indicated at 10 is supported with a bottom wall 12 thereof secured to a usual toilet generally indicated at 14, the toilet having the usual water passage 16 flow connected with the bowl thereof (not shown). Installed within the confines of the flush tank 10 and at the bottom wall 12 is a flush valve assembly generally indicated at 18 projecting downwardly through the flush tank bottom wall communicating into the toilet water passage 16, all generally in usual manner. The flush valve assembly 18 includes an overflow tube portion comprised of an upright overflow tube 20 and an overflow connector 22, and a valving portion comprised of a flush valve seat portion 24, a valve seat 26 and a closure member 28.

Again in usual form, the overflow tube 20 is an upright tube having an upper open end (not shown) spaced above the normal upper water level of the flush tank 10 and having its lower end secured in closed flow communication with the overflow connector 22. The overflow connector 22 is secured on and flow communicates inwardly into the flush valve seat portion 24 of the valving portion spaced below an upper end 30 of the flush valve seat portion. Thus, a closed flow communication is established from the upper end of the overflow tube 20 downwardly therethrough, through the overflow connector 22, through the flush valve seat portion 24 and into toilet water passage 16, such flow communication always remaining open regardless of the particular operation of the valving portion in order to serve the safety water overflow and toilet bowl refill functions as hereinbefore discussed.

Although the flush valve seat portion 24 could be formed as an integral part of the flush tank bottom wall 12, in this case, it is comprised of a tubular member opening upwardly into the flush tank 10 and downwardly into the toilet water passage 16. The flush valve seat portion 24 is secured sealed with the flush tank bottom wall 12 in usual manner and with the upper end 30 spaced slightly above the flush tank bottom wall. In many instances, surfaces 32 on the upper end 30 of the flush valve seat portion 24 form a valve seat for the valving portion of the flush valve assembly 18, but according to certain of the principles of the present invention, these upper end surfaces do not function as a valve seat as will be apparent from the following.

Figure 5:
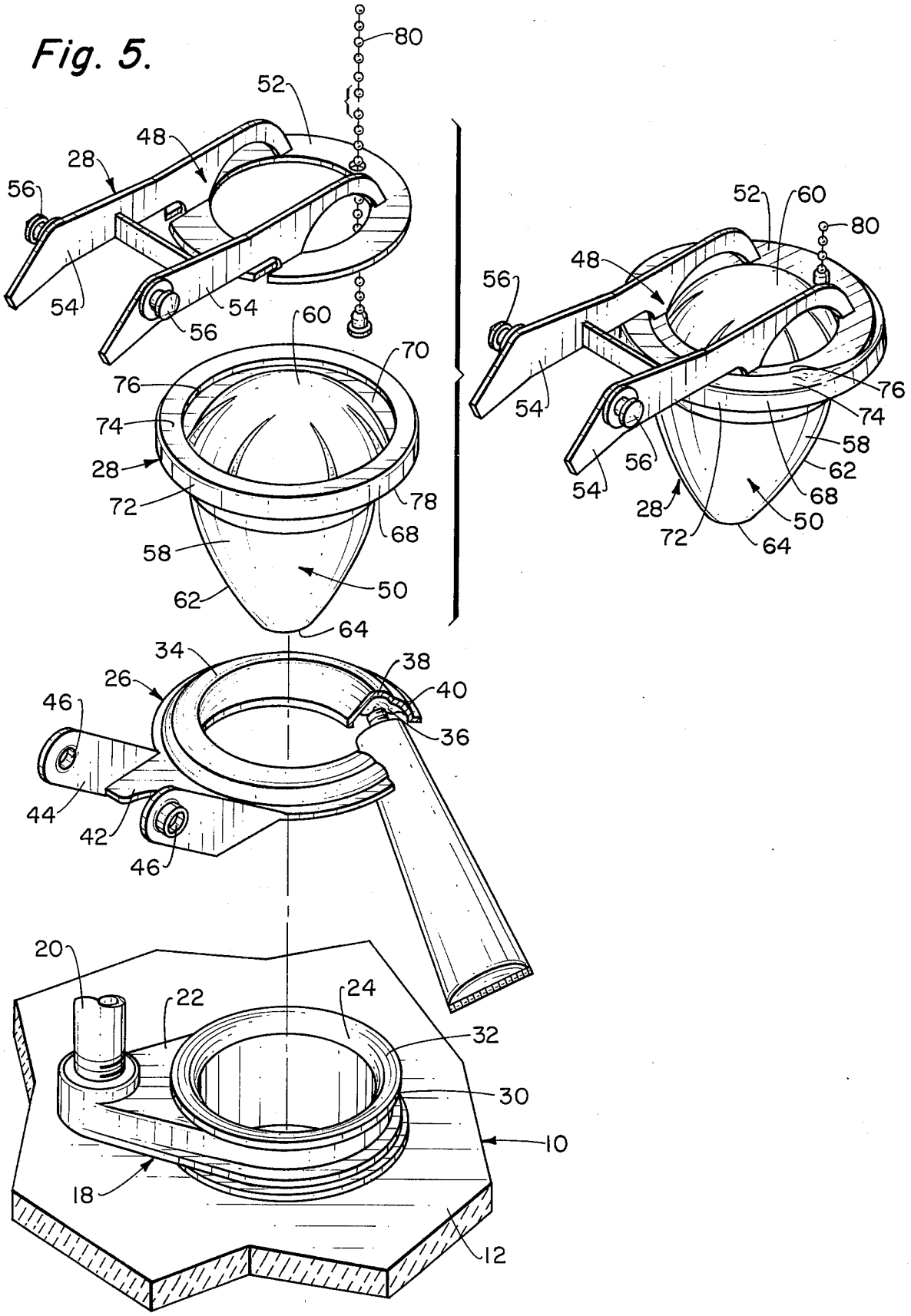
FIG. 5 is an exploded perspective view showing the valve seat and closure member assembly in various disassembled forms and illustrating the preferred manner of installation of the assembly into the overall flush valve and in the flush tank of FIGS. 1 through 4

More particularly to the principles of the present invention, the valve seat 26 is preferably formed of corrosion resistant, shaped metal such as stainless steel and includes a valve seat ring 34 overlying the upper end 30 of the flush valve seat portion 24 secured thereto and extending slightly downwardly into the flush valve seat portion by waterproof sealant 36. The waterproof sealant 36 may be of a usual form well known to those skilled in the art and available on the commercial market, its requirement being to firmly seat and secure the metal valve seat ring 34 to the metal of the flush valve seat portion 24. As illustrated in FIG. 5, the waterproof sealant 36 is applied in semifluid form to the undersurfaces of the valve seat ring 34, the valve seat ring is positioned firmly in place over the upper end 30 of the flush valve seat portion 24 and after a period for setting of the waterproof sealant, the valve seat ring is secured waterproof sealed ready for its intended functioning as will be hereinafter described.

Figure 3:
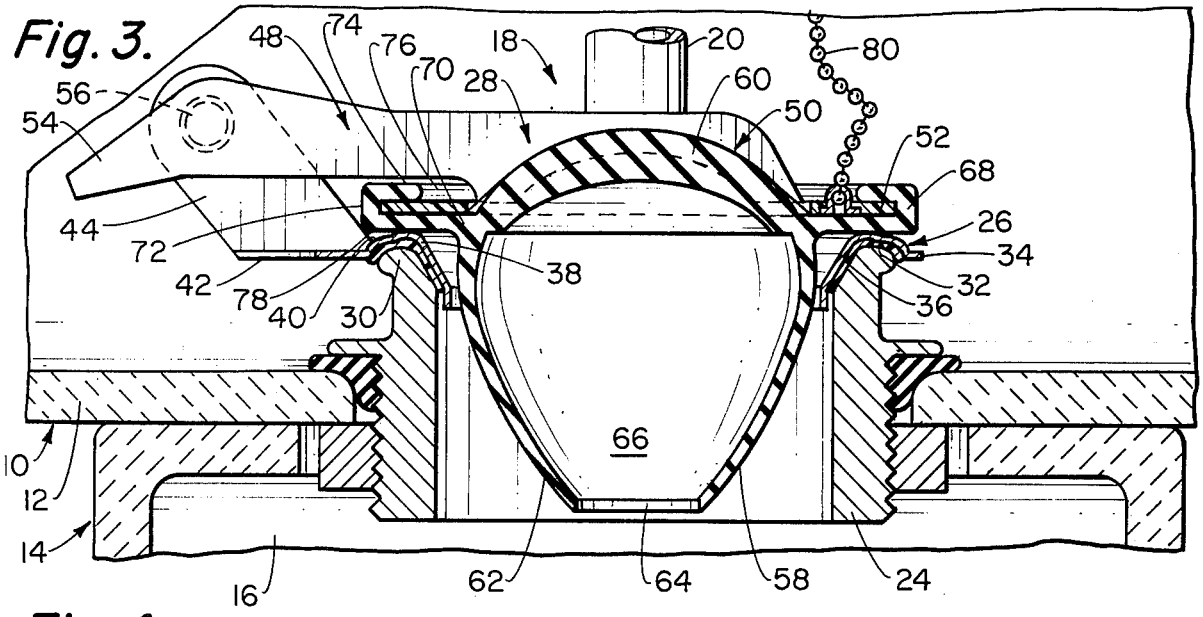
FIG. 3 is a fragmentary, vertical sectional view showing the valve seat and closure member assembly of FIGS. 1 and 2, looking in the direction of the arrows 3—3 in FIG. 2.
Figure 4:
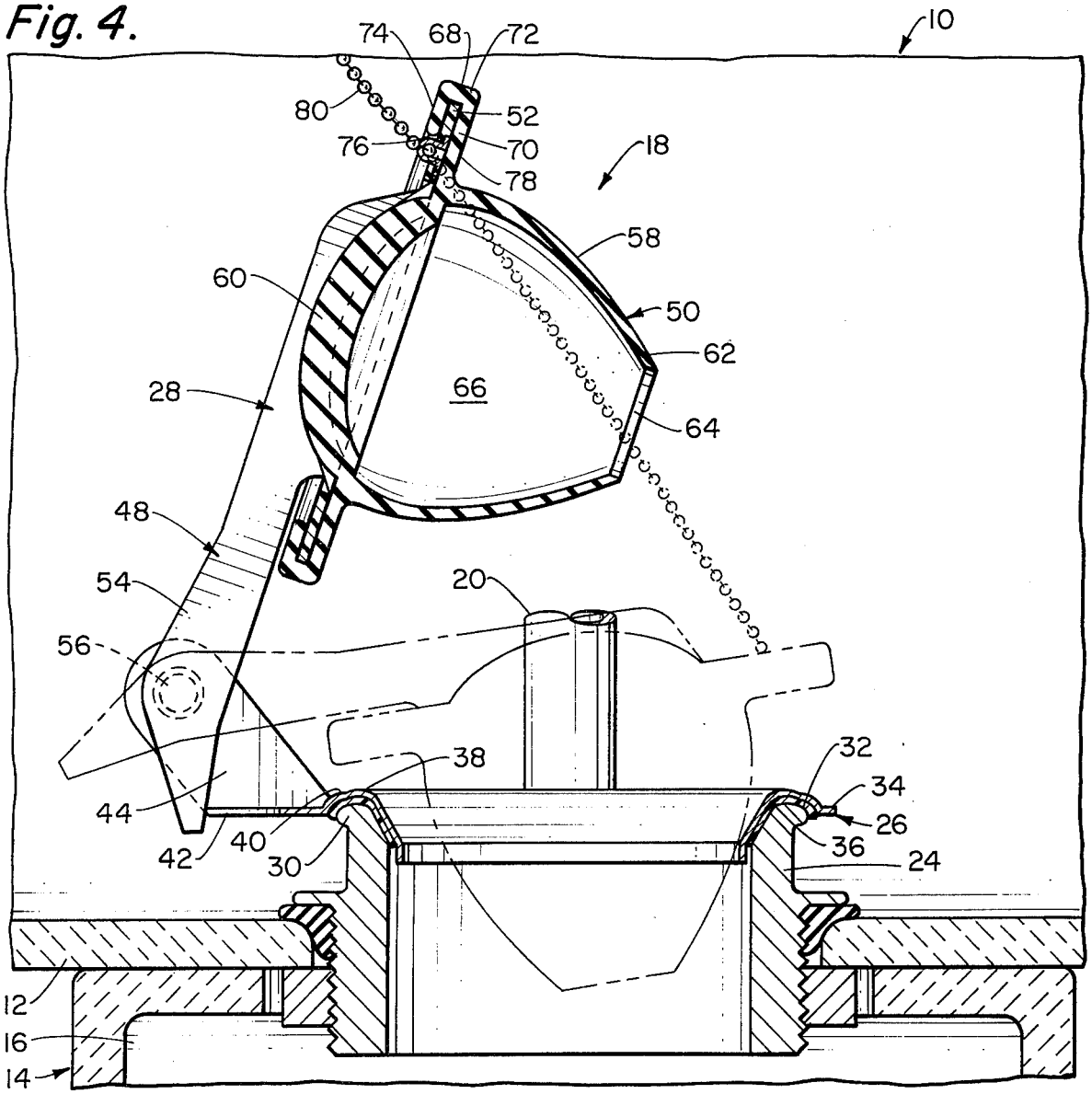
FIG. 4 is a view similar to FIG. 3, but showing the valve seat and closure member assembly in open position in full lines and in partially closed position in phantom lines.

As best seen in FIGS. 3, 4 and 5, the valve seat ring 34 is formed with two concentric, inner and outer ring portions 38 and 40, each projecting upwardly. As shown in FIGS. 3 and 4, each of the ring portions 38 and 40 is convex in radial cross-section. Furthermore, the inner ring portion 38 projects or depends upwardly spaced vertically or slightly higher than the lesser projection of the outer ring portion 40 for a purpose to be hereinafter pointed out.

A mounting portion 42 of the valve seat 26 extends transversely from one side of the valve seat ring 34 secured thereto preferably integral therewith. The mounting portion 42 is formed with horizontally spaced, upwardly and outwardly angled hinge connectors 44 having aligned hinge pin openings 46 formed therethrough. Thus, the specifically formed valve seat ring 34 and mounting portion 42 preferably make up the entire valve seat 26.

The closure member 28 includes a rigid frame 48 preferably formed of molded plastic and a resilient closure portion or closure element 50 preferably likewise molded, but of one of the well known rubber-like plastic resilient materials. The rigid frame 48 is comprised of an annular or ring part 52 having substantially flat upper and lower surfaces terminating radially outwardly in a circular periphery. Spaced support arm parts 54 are preferably integrally connected partially transversely spanning the ring part 52 and projecting upwardly therefrom. The support arm parts 54 project transversely from one side of the ring part 52 terminating outwardly spaced from the ring part with aligned hinge pins 56 at their outer extremities.

The closure portion or element 50 of the closure member 28 is comprised of a bulbous central part 58 which is hollow as can be seen in FIGS. 3 and 4 having a closed dome-shaped top wall 60 terminating outwardly in a circular periphery into a downwardly extending, somewhat arcuate surrounding side wall 62. The bulbous part side wall 62 terminates downwardly and inwardly in a circular opening 64 providing communication into a hollow interior 66 of the bulbous part. The bulbous central part 58, therefore, is provided as a closed, air containing chamber by the closed top and side walls 60 and 62 with the opening 64 communicating generally vertically upwardly into the hollow interior 66.

The closure portion or element 50 is further comprised of an outwardly projecting, annular, C-shaped flange 68 surrounding the bulbous central part 58 depending radially outwardly therefrom. The C-shaped flange 68 is formed by a lower leg 70 secured, preferably integrally, to the bulbous part 58 approximately at the juncture between the bulbous part top and side walls 60 and 62. The lower leg 70 projects transversely outwardly and terminates in a connected, generally upwardly extending, peripheral leg 72 which, in turn, terminates upwardly in a transversely inwardly depending, upper leg 74. The upper leg 74 terminates inwardly in a free edge 76 spaced from the bulbous part 58 so that the C-shaped flange 68 is inwardly and upwardly exposed adjacent the periphery of the bulbous part 58.

In the assembly of the closure member 28, the closure element 50 is positioned with the bulbous part top wall 60 received upwardly within the ring part 52 of the frame 48 and the upper leg 74 of the C-shaped flange 68 is deformed upwardly to permit the frame ring part to enter generally downwardly into the C-shaped flange. Thus, when the C-shaped flange 68 is permitted to return to shape, the flange upper leg 74 overlies and grips the frame ring part 52 while the frame ring part forms an upward rigid backing for the flange lower leg 70, all as best seen in FIGS. 3 and 4. The C-shaped flange 68 of the closure element 50, therefore, removably resiliently retains the bulbous part 58 on the frame ring part 52, while at the same time, the lower leg 70 forms a generally downwardly facing, relatively flat, resilient sealing surface 78.

In the overall assembly of the closure member 28 with the valve seat 26, the support arm parts 54 of the closure member frame 48 are received downwardly between the hinge connectors 44 of the valve seat mounting portion 42 with the hinge pins 56 of the closure member support arm parts extending outwardly through the hinge pin openings 46 of the valve seat hinge connectors, as shown in FIGS. 1 through 4. This hingedly mounts the closure member 28 on the valve seat 26 forming the hingedly connected closure member and valve seat as an integrated unit, the closure member being movable progressively angularly upwardly away from the valve seat and progressively angularly downwardly toward the valve seat. In the downward closed position of the closure member 28 with the valve seat 26 as can be particularly seen in FIG. 3, the sealing surface 78 of the closure member closure element 50 overlies and may seal downwardly against the valve seat ring 34 of the valve seat.

Figure 2:
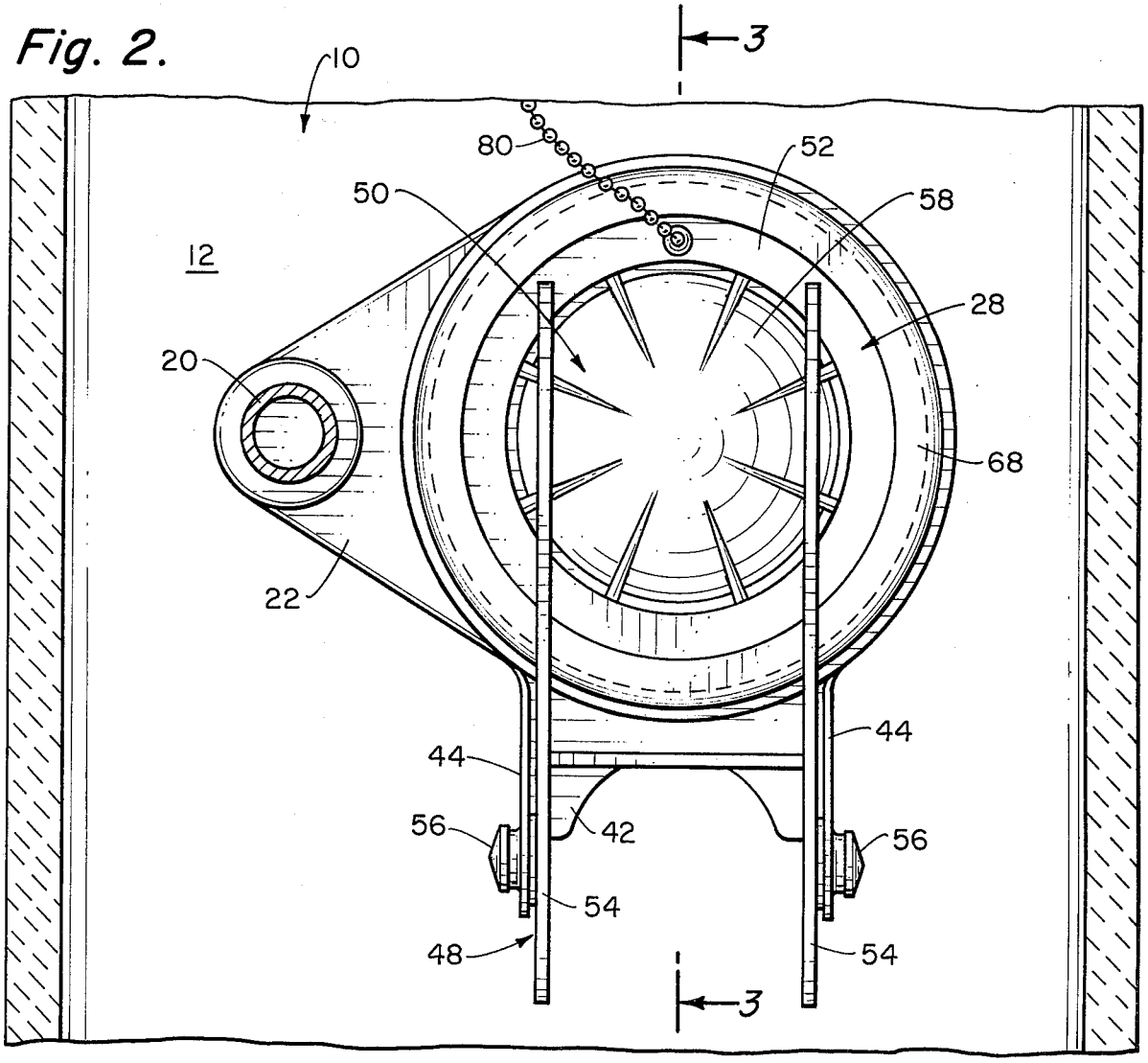
FIG. 2 is a fragmentary, top plan view showing the valve seat and closure member assembly of FIG. 1 looking in the direction of the arrows 2—2 in FIG. 1.

In operation of this preferred embodiment of the valve seat and closure member assembly of the present invention, with the valve seat 26 of the assembly sealed over the upper end of the flush valve seat portion 24, whether over a previous valve seat forming a replacement valve seat or as an original valve seat, sealed thereto by the waterproof sealant 36 as hereinbefore described, the integrated unit or assembly forms the valving portion of the flush valve assembly 18 within the flush tank 10. With the closure member 28 in closed position downwardly against the valve seat 26 as shown in FIGS. 1 through 3, the flush tank 10 is maintained filled with water to its normal upper water level as hereinbefore described, the resilient sealant surface 78 of the closure member sealing downwardly against the inner and/or outer ring portions 38 and 40 of the valve seat 26 preventing water flow downwardly through the flush valve seat portion 24. The flush tank 10, therefore, is in condition for a flushing action.

To begin the flushing action, the usual operating lever (not shown) on the flush tank 10 is actuated and through an actuating chain 80 connected downwardly within the flush tank to the frame 48 of the closure member 28, as shown in FIG. 3, the closure member is pivoted angularly upwardly relative to the valve seat 26 to open position as shown in full lines in FIG. 4. This opens the valving portion and the water of the flush tank 10 flows downwardly through the flush valve seat portion 24 into the water passage 16 of the toilet 14 and through the toilet bowl (not shown) carrying out the flushing action in the usual manner. Furthermore, the closure member 28 is retained angularly upwardly in its open position through flotation of the bulbous part 58 thereof having trapped air within its hollow interior creating the flotation effect.

As the water level in the flush tank 10 moves downwardly during this flushing operation and ultimately moves downwardly past the closure member 28, the closure member with its flotation effect rides angularly downwardly on such decreasing water level until in the approximate downward position shown in phantom lines in FIG. 4. At approximately this point, the relatively swift water flow downwardly through the flush valve seat portion 24 around the bulbous part 58 of the closure member 28 creates a vacuum or suction effect against this bulbous part drawing the closure member into tight sealing engagement with the valve seat 26, that is, the sealing surface 78 of the bulbous part C-shaped flange 68 on the closure member 28 tightly downwardly sealing against the valve seat 26 again assuming the downward sealed position shown in FIG. 3. In the meantime, the ball cock (not shown) of the flush tank 10 has opened admitting a flow of water into the flush tank and with the closed sealing of the closure member 28 against the valve seat 26, the flush tank is refilled, but during the rise of the water level in such refilling, the closure member 28 remains tightly sealed against the valve seat 26 since the closure member bulbous part 58 is primarily within the flush valve seat portion 24 not surrounded by water so that there is no flotation effect despite the air within the bulbous part.

According to the principles of the present invention, therefore, a unique integrated valve seat and closure member assembly forming the valving portion of flush valves for flush tanks and the like is hereby provided wherein such integrated assembly is preferably constructed as a completely separate, self-contained unit which may be mounted on virtually any flush valve seat portion, such as the flush valve seat portion 24 of the flush tank 10, either as an original valving portion unit or as a replacement unit. Furthermore, in the preferred form illustrated, such integrated valve seat and closure member assembly may be mounted solely supported on the particular flush valve seat portion sealed therewith preferably by waterproof sealant and does not depend on other components of the particular flush valve assembly for support or guiding. Although the integrated assembly may have the valve seat portion thereof, such as the valve seat 26, sealed to the flush valve seat portion by other well-known clamping and sealing means, use of the waterproof sealant permits accomplishment of the integrated assembly mounting in a simple and easy manner not requiring any special skills.

At the same time, during the mounting of the integrated valve seat and closure member assembly, no alignment problems are involved since the only requirement is that the valve seal portion of the integrated assembly is sealed to the particular flush valve seat portion. According to the present invention, the closure member of the integrated assembly is movably guided in its valving function directly on the valve seat portion, such as the closure member 28 hingedly connected to the valve seat 26 of the preferred embodiment described herein. Obviously, this means that the closure member is guided directly on the valve seat and all alignment between the two for an efficient sealing operation can be established during the original manufacture and connection between the valve seat and closure member.

A still further unique and advantageous feature of the present invention, illustrated in the preferred embodiment shown, is the functional interconnection between the closure element 50 and the frame 48 of the closure member 28. The frame ring part 52 quickly and conveniently assembles in the C-shaped flange 68 mounting the closure element on the frame in exact proper alignment whether the closure element is an original element or a replacement, and preferably at the same time, firmly backing the resilient material formed sealing surface 78 of the closure element for an efficient sealing operation with the valve seat 26 or any other similar valve seat. Thus, the principles of the closure member of the present invention are advantageously usable whether the closure member is a part of the integrated valve seat and closure member assembly of the present invention or is separately used in a different assembly.

Also, the valve seat of the present invention involves unique improvements advantageously usable in the integrated valve seat and closure member assembly of the present invention or separately therefrom. Referring to the preferred embodiment illustrated herein, the valve seat 26 includes the valve seat ring 34 having the sealing surface thereof provided with the concentric inner and outer ring portions 38 and 40 projecting upwardly therefrom and capable of coacting with virtually any closure member sealing surface which is resiliently compressible, such as the closure member sealing surface 78. Although merely equally upwardly projecting concentric rings will provide a more efficient sealing operation with the closure member sealing surface, as further illustrated herein, the greater upward projection of the inner ring portion 38 from the upward projection of the outer ring portion 40 provides the sealing with the closure member sealing surface in the initial use of the closure member with the inner, greater projecting ring portion until the closure member resilient sealing surface is compressed thereby and thereafter, the sealing against such resilient sealing surface will take place at both ring portions. This insures more efficient sealing therebetween and over a far greater period of useful life.

We claim:

1. In a flush valve for flush tanks and the like, the flush tanks being of the type having a flush valve seat portion opening downwardly therethrough with an upper end portion having a generally upwardly facing annular end surface; the combination of: an integrated unitary valve seat and closure member assembly adapted for fabrication and assembly completely separate of said flush valve seat portion; the valve seat comprising a seat ring adapted to generally overlie the upwardly facing annular end surface of the flush valve seat portion, a mounting portion connected to and projecting generally transversely from said seat ring; the closure member comprising a guide portion hingedly connected to said mounting portion of said seat ring hingedly guiding said closure member in upwardly angled opening and downward closing hinged movements relative to said valve seat, a closure portion connected to said guide portion having an annular sealing surface facing and abuttingly sealing against said seat ring in a closure member downward closed position; sealing means in the form of a waterproof sealant adapted for installation between and for retaining said valve seat over said upper end portion of said tank flush valve seat portion, said sealant being the sole means required for retaining said separate integrated unitary assembly on said tank flush valve seat portion and through said valve seat said separate integrated unitary assembly supported in a flush tank.

2. In a flush valve as defined in claim 1 in which said tank flush valve seat portion is of the type which includes an original valve seat at said generally upwardly facing annular end surface; and in which said seat ring of said integrated assembly valve seat is a replacement seat ring and is adapted for being sealed over said end surface of said flush valve seat portion solely by said sealant.

3. In a flush valve as defined in claim 1 in which said guide portion of said integrated assembly closure member includes a rigid frame with a part thereof terminating transversely in a circular periphery and having generally transverse upper and lower surfaces; and in which said closure portion of said integrated assembly closure member is formed of resilient material and has a part thereof terminating transversely in an annular transverse flange portion, said flange portion forming a transversely inwardly opening annular slot receiving said guide portion rigid frame part transversely therein selectively removably mounting said closure portion on said guide portion rigid frame part, said closure portion flange forming a downwardly facing sealing surface backed by said guide portion rigid frame part in said annular slot of said closure portion part, said sealing surface sealing against said seat ring of said integrated assembly valve seat in a closure member downward closed position.

4. In a flush valve as defined in claim 1 in which said seat ring of said integrated assembly valve seat includes a generally upwardly facing annular sealing surface about said seat ring having a multiplicity of convex concentric rings formed thereon each circumscribing said seat ring and each projecting generally upwardly toward said closure member, said closure portion sealing surface of said integrated assembly closure member being a resilient surface and sealing generally downwardly against said seat ring sealing surface and said sealing surface rings in said closure member downward closed position.

5. In a flush valve as defined in claim 1 in which said seat ring of said integrated assembly valve seat includes a generally upwardly facing annular sealing surface about said seat ring having at least two concentric rings formed thereon each circumscribing said seat ring and each projecting generally upwardly toward said closure member, one of said rings projecting generally upwardly a greater distance and the other of said rings a lesser distance; and in which said closure portion sealing surface of said integrated assembly closure member is formed of resilient material sealing generally downwardly against said seat ring sealing surface in said closure member downward closed position, said closure portion sealing surface sealing primarily downwardly against said greater projecting ring of said seat ring sealing surface during initial use of said integrated valve seat and closure member assembly and sealing downwardly against both said greater and lesser projecting rings of said seat ring sealing surface during later use of said integrated valve seat and closure member assembly after said initial use and said greater projecting ring has formed an impressed ring groove in said closure portion sealing surface.

6. In a flush valve as defined in claim 1 in which said seat ring of said integrated assembly valve seat includes a generally upwardly facing annular sealing surface about said seat ring formed with at least two concentric rings each circumscribing said seat ring and each projecting generally upwardly toward said closure member, one of said concentric rings projecting upwardly a greater distance and the other a lesser distance; in which said guide portion of said integrated assembly closure member includes a rigid frame with a part thereof terminating transversely in a circular periphery and having generally transverse upper and lower surfaces; and in which said closure portion of said integrated assembly closure member is formed of resilient material and has a part thereof terminating transversely in an annular transverse flange portion, said flange portion forming a transversely inwardly opening annular slot receiving said guide portion rigid frame part transversely therein selectively removably mounting said closure portion on said guide portion rigid frame part, said closure portion flange forming a downwardly facing sealing surface backed by said guide portion rigid frame part in said annular slot of said closure portion part, said sealing surface sealing against said seat ring sealing surface of said valve seat in said closure member downward closed position.

7. In a flush valve for flush tanks and the like, the flush tanks being of the type having a flush valve seat portion opening downwardly therethrough with an upper end portion having a generally upwardly facing annular end surface; the combination of: an integrated unitary valve seat and closure member assembly adapted for fabrication and assembly completely separate of said flush valve seat portion; the valve seat comprising a seat ring adapted to generally overlie the upwardly facing annular end surface of the flush valve seat portion, a mounting portion connected to and projecting generally transversely from said seat ring; the closure member comprising a guide portion hingedly connected to said mounting portion of said seat ring hingedly guiding said closure member in upwardly angled opening and downward closing hinged movements relative to said valve seat, a closure portion connected to said guide portion having an annular sealing surface facing and abuttingly sealing against said seat ring in a closure member downward closed position; sealing means adapted for connection between and retaining said valve seat over said upper end portion of said tank flush valve seat portion and through said valve seat said integrated assembly supported in a flush tank; said guide portion of said closure member including a rigid frame with a part thereof terminating transversely in a circular periphery and having generally transverse upper and lower surfaces; said closure portion of said closure member being formed of resilient material and having a part thereof terminating transversely in an annular transverse flange portion, said flange portion forming a transversely inwardly opening annular slot receiving said guide portion rigid frame part transversely therein selectively removably mounting said closure portion on said guide portion rigid frame part, said closure portion flange forming a downwardly facing sealing surface backed by said guide portion rigid frame part in said annular slot of said closure portion part, said sealing surface sealing against said seat ring of said valve seat in a closure member downward closed position.

8. In a flush valve as defined in claim 7 in which said seat ring of said integrated assembly valve seat includes a generally upwardly facing annular sealing surface about said seat ring having a multiplicity of convex concentric rings formed thereon each circumscribing said seat ring and each projecting generally upwardly toward said closure member, said closure portion sealing surface of said integrated assembly closure member being a resilient surface and sealing generally downwardly against said seat ring sealing surface and said sealing surface rings in said closure member downward closed position.

9. In a flush valve as defined in claim 7 in which said seat ring of said integrated assembly valve seat includes a generally upwardly facing annular sealing surface about said seat ring having at least two concentric rings formed thereon each circumscribing said seat ring and each projecting generally upwardly toward said closure member, one of said rings projecting generally upwardly a greater distance and the other of said rings a lesser distance; and in which said closure portion sealing surface of said integrated assembly closure member is formed of resilient material sealing generally downwardly against said seat ring sealing surface in said closure member downward closed position, said closure portion sealing surface sealing primarily downwardly against said greater projecting ring of said seat ring sealing surface during initial use of said integrated valve seat and closure member assembly and sealing downwardly against both said greater and lesser projecting rings of said seat ring sealing surface during later use of said intergrated valve seat and closure member assembly after said initial use and said greater projecting ring has formed an impressed ring groove in said closure portion sealing surface.

10. In a flush valve for flush tanks and the like, the flush tanks being of the type having a flush valve seat portion opening downwardly therethrough with an upper end portion having a generally upwardly facing annular end surface; the combination of: an integrated unitary valve seat and closure member assembly adapted for fabrication and assembly completely separate of said flush valve seat portion; the valve seat comprising a seat ring adapted to generally overlie the upwardly facing annular end surface of the flush valve seat portion, a mounting portion connected to and projecting generally transversely from said seat ring; the closure member comprising a guide portion hingedly connected to said mounting portion of said seat ring hingedly guiding said closure member in upwardly angled opening and downward closing hinged movements relative to said valve seat, a closure portion connected to said guide portion having an annular sealing surface facing and abuttingly sealing against said seat ring in a closure member downward closed position; sealing means adapted for connection between and retaining said valve seat over said upper end portion of said tank flush valve seat portion and through said valve seat said integrated assembly supported in a flush tank; said seat ring of said valve seat including a generally upwardly facing annular sealing surface about said seat ring having a multiplicity of convex concentric rings formed thereon each circumscribing said seat ring and each projecting generally upwardly toward said closure member, said closure portion sealing surface of said closure member being a resilient surface and sealing generally downwardly against said seat ring sealing surface and said sealing surface rings in said closure member downward closed position.

11. In a flush valve as defined in claim 10 in which said seat ring of said integrated assembly valve seat includes said generally upwardly facing annular sealing surface about said seat ring having at least two convex concentric rings formed thereon each circumscribing said seat ring and each projecting generally upwardly toward said closure member, one of said concentric rings projecting upwardly a greater distance and the other a lesser distance, said closure portion resilient sealing surface of said integrated assembly closure member sealing generally downwardly against said seat ring sealing surface and said sealing surface rings in said closure member downward closed position.

12. In a flush valve as defined in claim 10 in which said seat ring of said integrated assembly valve seat includes said generally upwardly facing annular sealing surface about said seat ring having at least two concentric rings formed thereon each circumscribing said seat ring and each projecting generally upwardly toward said closure member, one of said rings projecting generally upwardly a greater distance and the other of said rings a lesser distance; and in which said closure portion resilient sealing surface of said integrated assembly closure member in said closure member downward closed position seals primarily downwardly against said greater projecting ring of said seat ring sealing surface during initial use of said integrated valve seat and closure member asembly and seals downwardly against both said greater and lesser projecting rings of said seat ring sealing surface during later use of said integrated valve seat and closure member assembly after said initial use and said greater projecting ring has formed an impressed ring groove in said closure portion sealing surface.

13. In a flush valve for flush tanks and the like, the flush tanks being of the type having a flush valve seat portion opening downwardly therethrough with an upper end portion having a generally upwardly facing annular end surface; the combination of: an integrated unitary valve seat and closure member assembly adapted for fabrication and assembly completely separate of said flush valve seat portion; the valve seat comprising a seat ring adapted to generally overlie the upwardly facing annular end surface of the flush valve seat portion, a mounting portion connected to and projecting generally transversely from said seat ring; the closure member comprising a guide portion hingedly connected to said mounting portion of said seat ring hingedly guiding said closure member in upwardly angled opening and downward closing hinged movements relative to said valve seat, a closure portion connected to said guide portion having an annular sealing surface facing and abuttingly sealing against said seat ring in a closure member downward closed position; securement means adapted for being confined to said upper end portion of said flush valve seat portion and free of any flush tank walls for securing and sealing said valve seat over said upper end portion of said tank flush valve seat portion retaining said separate integrated unitary assembly on said tank flush valve seat portion and through said valve seat said separate integrated unitary assembly supported in a flush tank.

14. In a flush valve as defined in claim 13 in which said tank flush valve seat portion is of the type which includes an original valve seat at said generally upwardly facing annular end surface; and in which said seat ring of said integrated assembly valve seat is a replacement seat ring and is adapted for being secured sealed over said end surface of said flush valve seat portion by said securement means.

* * * * *